US006834414B2

(12) United States Patent
Chiu

(10) Patent No.: US 6,834,414 B2
(45) Date of Patent: Dec. 28, 2004

(54) DOORKNOB COVER CAPABLE OF ATTRACTING OR BEING ATTRACTED MAGNETICALLY

(76) Inventor: Shyue-Ding Chiu, No. 390 Juliau Rd., Dashu Shiang Kaohsiung (TW), 840

( * ) Notice: Subject to any disclaimer, the term of this patent is extended or adjusted under 35 U.S.C. 154(b) by 0 days.

(21) Appl. No.: 10/356,555

(22) Filed: Feb. 3, 2003

(65) Prior Publication Data

US 2004/0148734 A1 Aug. 5, 2004

(51) Int. Cl.[7] ..... E05F 5/02
(52) U.S. Cl. ..... 16/82; 292/251.5
(58) Field of Search ..... 16/82, 85, 86 A, 16/86 R, 441, 413, 412; 292/251.5, DIG. 15, DIG. 19

(56) References Cited

U.S. PATENT DOCUMENTS 1,830,383 A * 11/1931 Bos ..... 74/558.5
1,860,326 A * 5/1932 Jackson ..... 292/114
2,131,067 A * 9/1938 Paden ..... 292/347
2,247,592 A * 7/1941 Swift ..... 70/455
2,519,435 A * 8/1950 Byrd, Jr. ..... 292/251.5
2,731,056 A * 1/1956 Anson ..... 16/86 A
3,100,664 A * 8/1963 Duval ..... 292/251.5
3,701,557 A * 10/1972 Centofante et al. ..... 292/251.5
4,181,339 A * 1/1980 Rigsby ..... 292/347
4,951,984 A * 8/1990 Huang ..... 292/76
5,010,622 A * 4/1991 Morita ..... 16/85
5,701,635 A * 12/1997 Hawkes ..... 16/421
5,944,368 A * 8/1999 Hastings ..... 292/251.5

* cited by examiner

*Primary Examiner*—Chuck Y. Mah

(57) ABSTRACT

A doorknob cover comprise a hollow cylindrical body and an element which is capable of attracting magnetically or being attracted magnetically. The cylindrical body is provided in one side with an elastic opening, and in other side with the element. The doorknob cover is fitted over the doorknob via the elastic opening. As the door is swiveled toward a wall, the doorknob is arrested by a magnetic seat of the wall due to the magnetic attraction between the element of the doorknob and the magnetic seat of the wall.

13 Claims, 8 Drawing Sheets

DOORKNOB COVER CAPABLE OF ATTRACTING OR BEING ATTRACTED MAGNETICALLY

FIELD OF THE INVENTION

The present invention relates generally to a doorknob, and more particularly to a doorknob cover which is provided with a means to attract magnetically or a means to be attracted magnetically, so as to enable the door to be held at an open position.

BACKGROUND OF THE INVENTION

As shown in FIG. 1 to FIG. 5, the U.S. Pat. No. 5,701,635 discloses a doorknob cover 10 which is made of an elastic material, such as polyurethane, rubber, etc. The doorknob cover 10 is provided in the interior with a receive chamber 11. The receive chamber 11 is provided with a circular opening 12 through which the doorknob "H" is inserted to press against an interior surface 13 of the receive chamber 11, thereby enabling the doorknob cover 10 to fitting completely over the doorknob "H". When the door "D" is forcibly opened to hit a wall "W", the doorknob cover 10 is impacted to deform such that the reaction force is absorbed by a thickness "T" which is measured from the outermost surface of the doorknob cover 10 to the interior surface 13, as illustrated in FIG. 2 and FIG. 3. In light of the protective effect of the doorknob cover 10, the doorknob "H" is provided with protection against damage in the event that the door "D" is slammed against the wall "W".

The prior art doorknob cover 10 described above is defective in design in that the doorknob cover 10 is bound to bounce back upon hitting the wall "W", as illustrated in FIG. 4. As a result, the door "D" may accidentally hit a tray held in one hand of a person opening the door "D". Such an incident may result in a messy situation. In order to prevent the incident from taking place, the person may use one of his or her hips to stop the door "D" from springing back. In addition, the door "D" may be playfully slammed against the wall "W" by the children, who are vulnerable to being hit on the face by the door "D" in the event that the doorknob cover 10 springs back fast upon hitting the wall "W". In addition, the prior art doorknob cover 10 is by no means a handy device if it is used to fit with a doorknob "H'" which is provided with a push-button lock bolt "h", as shown in FIG. 5. In view of the fact that the push-button lock bolt "h" is completely obstructed by the "T2" portion of the doorknob cover 10. The push-button lock bolt "h" can not be easily pushed to keep the doorknob H' in the on-lock state. It might be even necessary that the doorknob cover 10 is entirely removed from the doorknob H' so as to keep the doorknob H' in the off-lock state. Moreover, the prior art doorknob cover 10 may bring about an inconvenience at the time when the door "D" is intentionally kept open to facilitate the moving of an object into or out of a room or house. The door that is kept open may be closed by the force of wind or other element. A wedge-shaped device is often used to arrest the door in such a way that the wedge-shaped device is placed between the bottom rail of the door and the floor surface.

SUMMARY OF THE PRESENT INVENTION

It is the primary objective of the present invention to provide a doorknob cover capable of being arrested by a wall toward which the door is swiveled, thereby enabling the door to be kept open without the use of a doorstop device. The doorknob cover of the present invention is adapted to a push-button doorknob without obstructing the push-button lock bolt of the push-button doorknob.

In keeping with the principle of the present invention, the foregoing objective of the present invention is attained by a doorknob cover which is provided at an outer end with a magnet or iron. A wall is provided with an iron or magnet corresponding in location to the doorknob. As the door is swiveled toward the wall, the doorknob cover is arrested by the wall in such a way that the magnet of the doorknob cover attracts the iron of the wall, or vice versa.

The features and the advantages of the present invention will be more readily understood upon a thoughtful deliberation of the following detailed description of four preferred embodiments of the present invention with reference to the accompanying drawings.

DETAILED DESCRIPTION OF THE PREFERRED EMBODIMENT

Figure 7A:
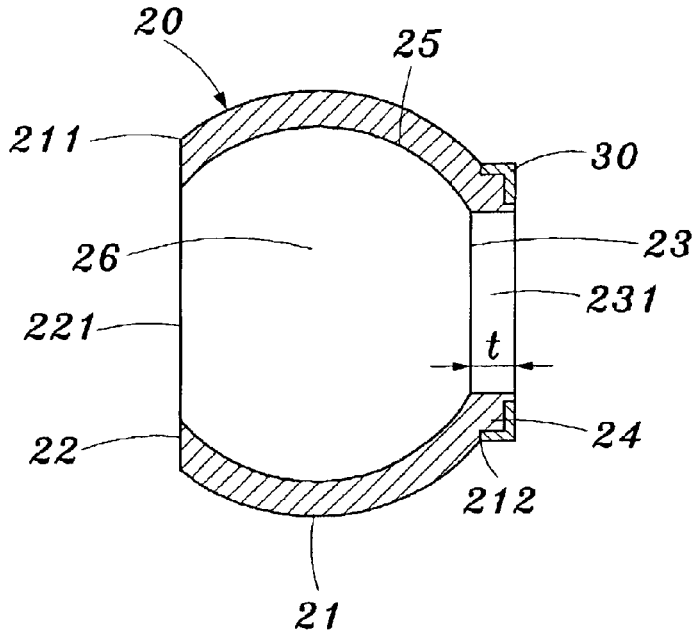
FIG. 7A shows a sectional schematic view of the first preferred embodiment of he present invention.
Figure 8A:
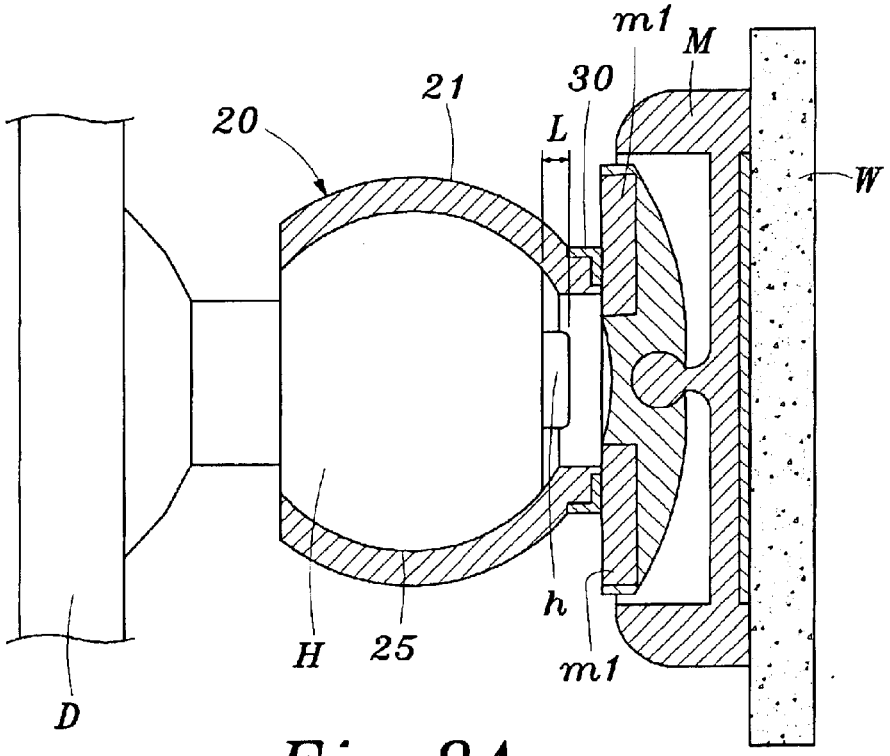
FIG. 8A shows a sectional schematic view of the first preferred embodiment of the present invention at work.

As shown in FIG. 7A, a doorknob cover of the first preferred embodiment of the present invention is formed of a hollow cylindrical body 20 and an element 30 capable of being attracted magnetically. The cylindrical body 20 is made of polyurethane or rubber by injection molding. The cylindrical body 20 is shaped to fit over a doorknob H and is provided with an outer surface 21, a first side surface 22, and a second side surface 23. The outer surface 21 has a first side end 211 and a second side end 212. The first side surface 22 is connected with the first side end 211 of the outer surface 21 and is provided at the center with a first hole edge 221 which has a hole diameter smaller than an outer diameter of the doorknob H. The second side surface 23 is connected with the second side end 212 of the outer side surface 21 and is provided at the center with a second hole edge 231 which has a hole diameter smaller than an outer diameter of the doorknob H. The second hole edge 231 and the second side surface 23 are provided therebetween with a protruded rib 24 which has a thickness t greater than the greatest extension length L of a lock bolt h of the doorknob H, as shown in FIG. 8A. The second hole edge 231 and the first hole edge 221 are provided therebetween with a continuous wall 25. A hollow receiving cell 2*b* is formed and defined by the continuous wall 25, the first hole edge 221, and the second hole edge 231. The element 30 is a metal material capable of being attracted magnetically and is mounted on the outermost edge of the protruded rib 24 of the cylindrical body 20 in the course of the injection molding.

Figure 7B:
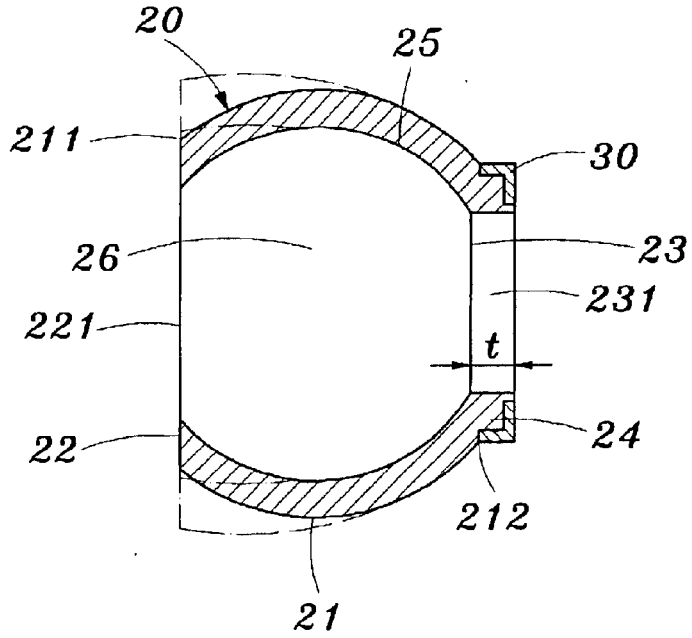
FIG. 7B shows a sectional schematic view of the first preferred embodiment of the present invention in action.

As shown in FIG. 7B, when the cylindrical body 20 is made by the injection molding, the portion defined by the continuous wall 25, the first side surface 22, and the proximity of the outer side surface 21 of the first side surface 22 is made of an elastic material, thereby providing the first hole edge 221 with an expandable opening to facilitate the fitting of the cylindrical body 20 over the doorknob H. The opening of the first hole edge 221 is shown by the dotted lines in FIG. 7B.

Figure 1:
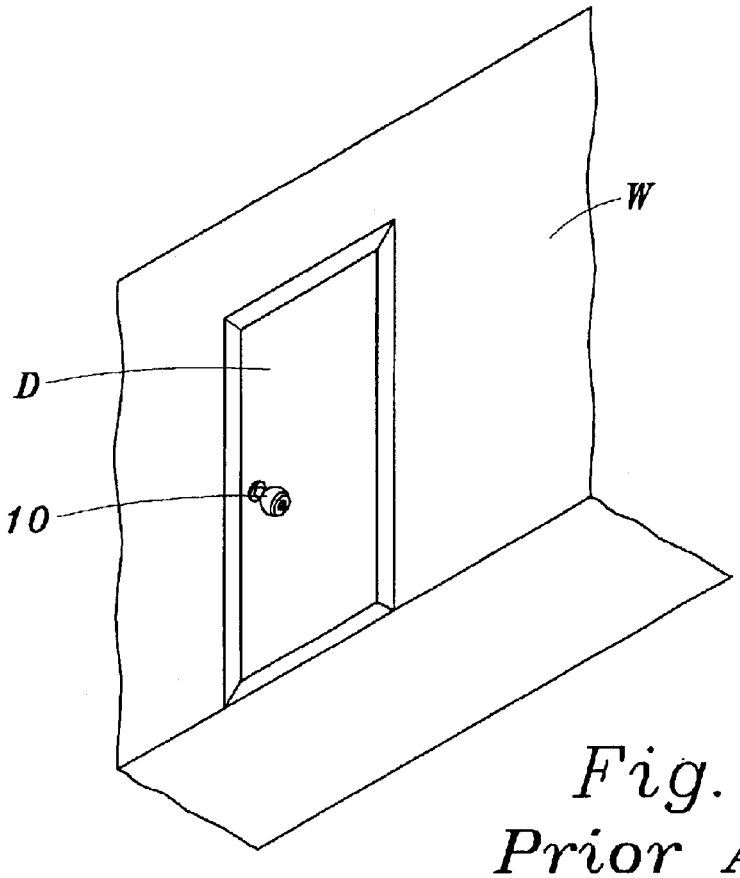
Fig. 1 Prior Art
FIG. 1 shows a perspective view of a doorknob cover of the prior art in use.
Figure 2:
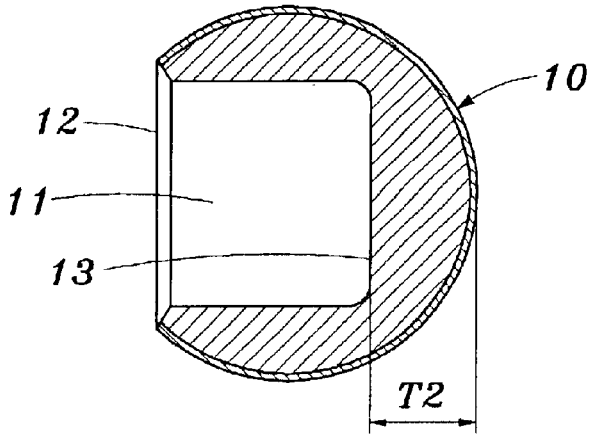
Fig. 2 Prior Art
FIG. 2 shows a sectional schematic view of the doorknob cover of the prior art.
Figure 3:
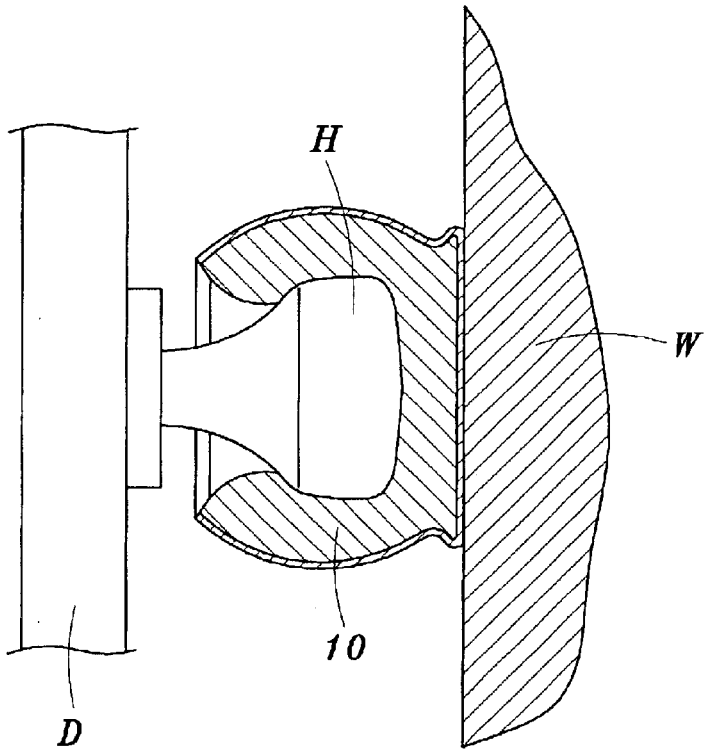
Fig. 3 Prior Art
FIG. 3 shows a schematic view of the prior art doorknob cover in contact with a wall.
Figure 4:
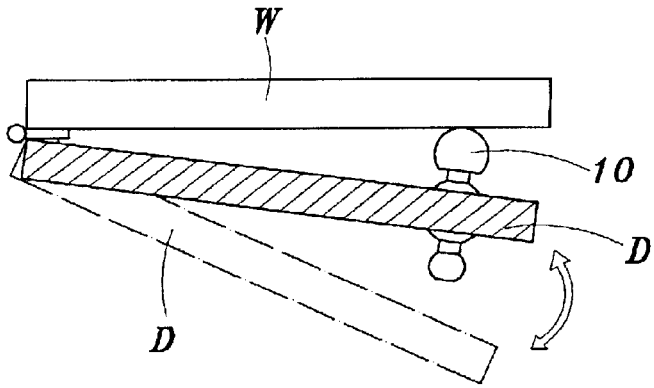
Fig. 4 Prior Art
FIG. 4 shows a schematic view of the prior art doorknob cover bouncing back from the wall upon having impacted on the wall.
Figure 5:
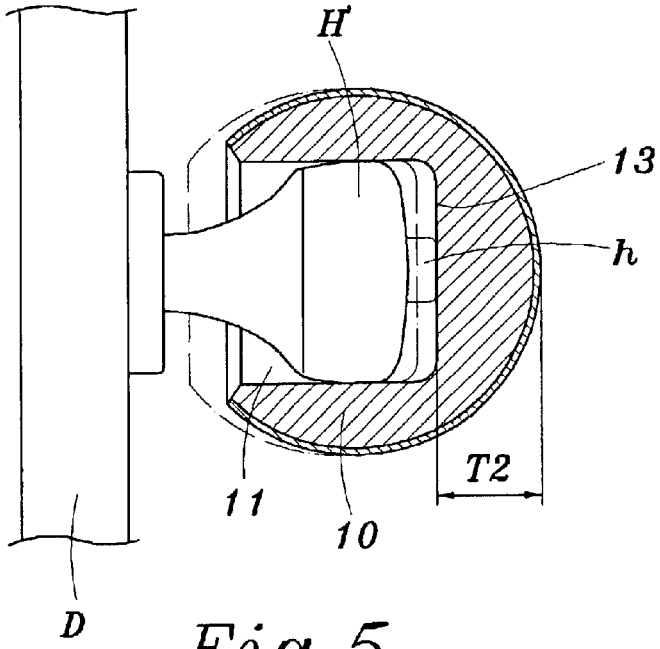
Fig.5 Prior Art
FIG. 5 shows a schematic view of the prior art doorknob cover being fitted over a doorknob which is provided with a push-button lock bolt.
Figure 6:
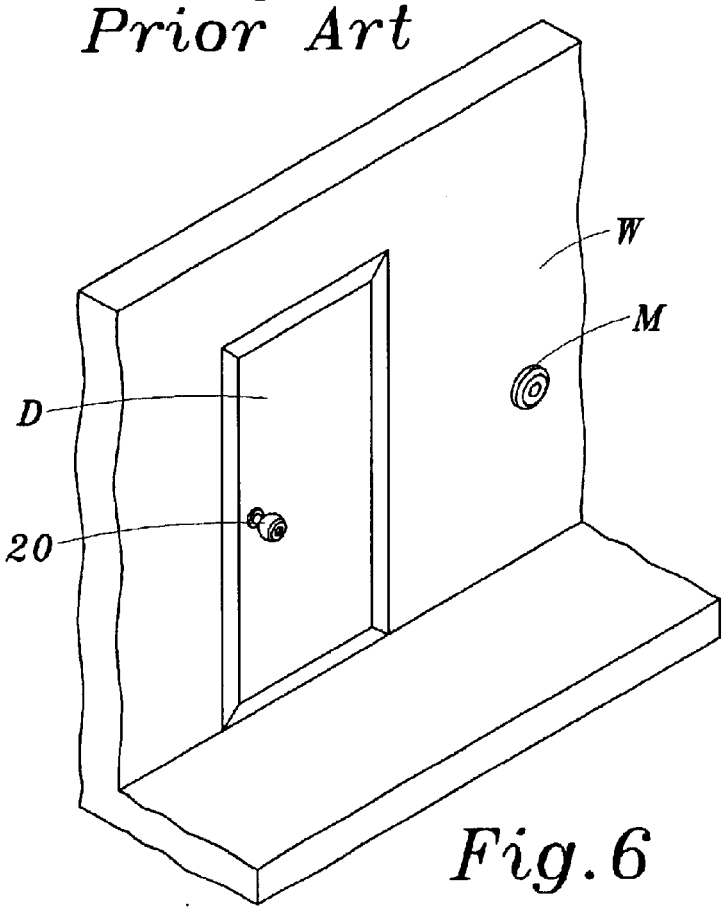
FIG. 6 shows a perspective view of a first preferred embodiment of the present invention in use.

As shown in FIG. 6, a wall W is provided with a magnetic seat M corresponding in location to the doorknob H. The magnetic seat M is provided with a magnet m1 or a metal piece m2, by means of which the doorknob cover of the present invention is arrested. The magnetic seat M is a prior art structure and is not a subject matter of the present invention.

As shown in FIG. 8A, the first hole edge 221 of the cylindrical body 20 is stretched out by fingers or a hand tool before the cylindrical body 20 is fitted over the doorknob H in such a way that the doorknob H is held in the receiving cell 26 of the cylindrical body 20. When the door D is swiveled toward the wall W, the element 30 of the doorknob cover of the present invention is attracted by the magnet m1 of the magnetic seat M of the wall W. As a result, the door D is held open without the use of a conventional doorstop device. Meanwhile, the door D is prevented from bouncing back. As the element 30 is attracted by the magnet m1 of the magnetic seat M, the protruded rib 24 is not deformed so as to prevent the lock bolt h of the doorknob H from being impacted to be in the on-lock state at the time when the doorknob H hits the magnetic seat M of the wall W. When the doorknob of other side of the door D is pulled with hand, the cylindrical body 20 is forcibly separated from the magnetic seat M of the wall W without being removed from the doorknob D. This is due to the fact that the first hole edge 24 of the cylindrical body 20 and the continuous wall 25 embrace securely the doorknob D, and that the hole diameter of the first hole edge 221 is smaller than the outer surface of the doorknob D.

Figure 8B:
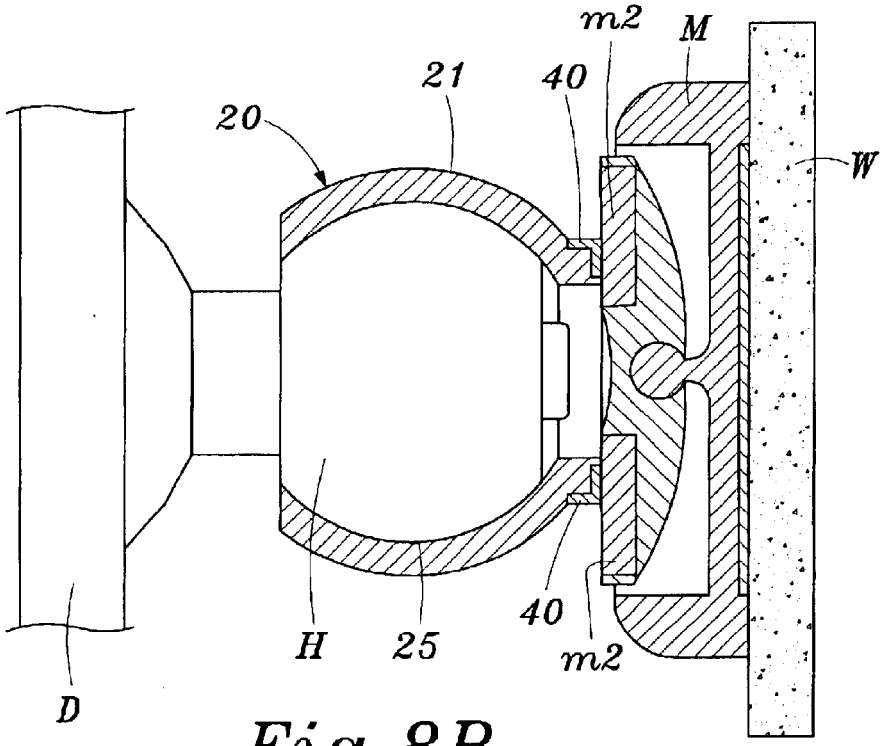
FIG. 8B shows another sectional schematic view of the first preferred embodiment of the present invention at work.

As shown in FIG. 8B, the element 30 of the doorknob cover of the present invention is replaced by a magnetic element 40 while the magnet m1 of the magnetic seat M of the wall W is replaced by a metal piece m2. As the door D is swiveled toward the wall W, the doorknob H is arrested by the wall W due to the magnetic attraction of the magnetic element 40.

Figure 9:
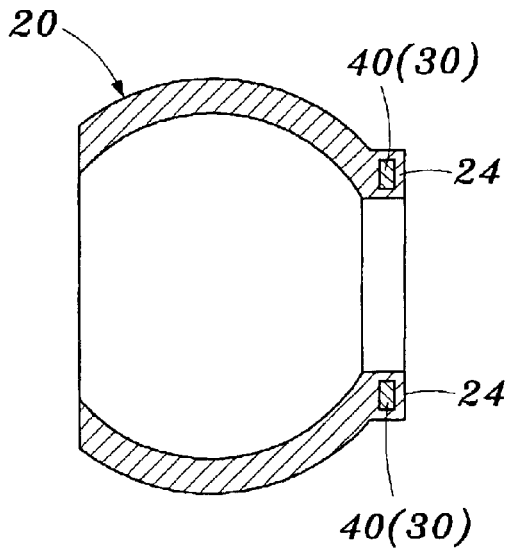
FIG. 9 shows a sectional schematic view of a second preferred embodiment of the present invention.

As shown in FIG. 9, the element 40 or the element 30 of the second preferred embodiment of the present invention is embedded in the protruded rib 24 of the cylindrical body 20 in the course of injection molding by which the cylindrical body 20 is made.

Figure 10:
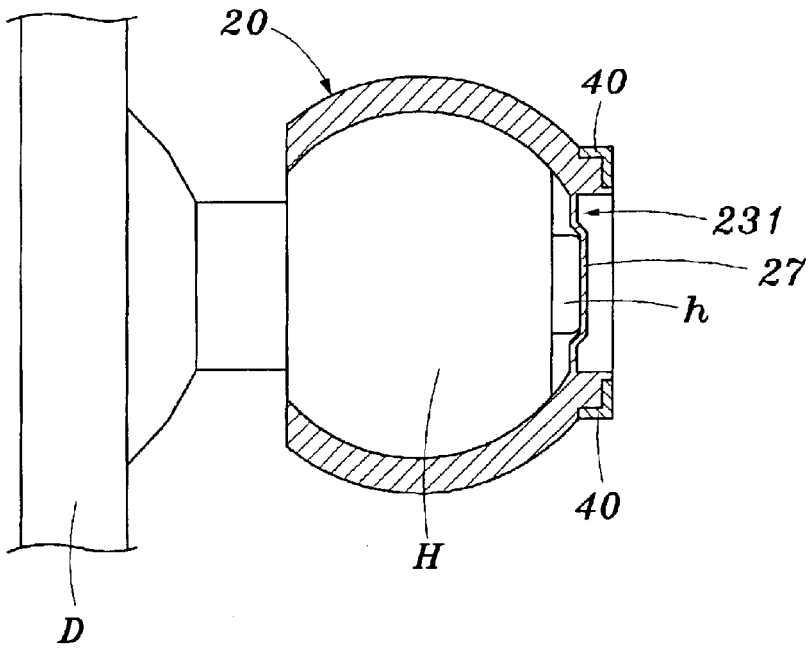
FIG. 10 shows another sectional schematic view of the second preferred embodiment of the present invention comprising an elastic film.

As shown in FIG. 10, the second hole edge 231 of the cylindrical body 20 is provided with an elastic film 27, which seals off the second hole edge 231 and the lock bolt h of the doorknob H, thereby preventing the lock bolt h from being pushed playfully by a child. In light of the elasticity of the elastic film 27, the lock bolt h of the doorknob H can be normally operated. In another words, the elastic film 27 does not obstruct the working of the lock bolt h; it serves to conceal the lock bolt h.

Figure 11:
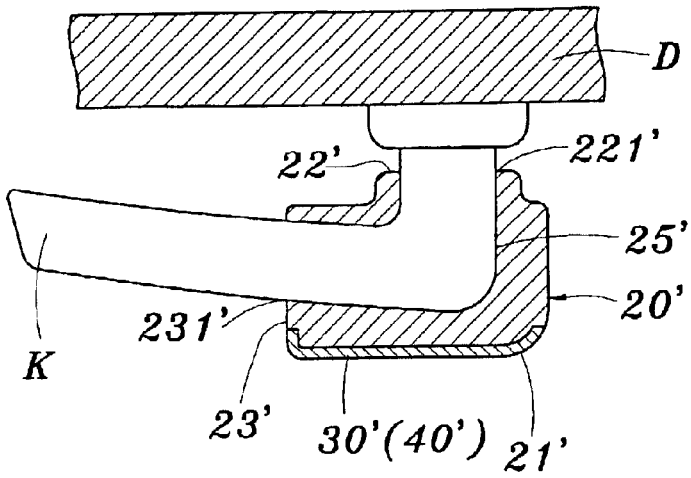
FIG. 11 shows a sectional schematic view of a third preferred embodiment of the present invention.

As shown in FIG. 11, the doorknob cover of the third preferred embodiment of the present invention is designed to cooperate with an L-shaped doorknob K. The cylindrical body 20' is provided with an L-shaped outer surface 21'. The first side surface 22' and the second side surface 23' are located respectively at two ends of the L-shaped outer surface 21' and are connected with the continuous wall 25' located between the first hole edge 221' of the first side surface 22' and the second hole edge 231' of the second side surface 23'. The continuous wall 25' is also L-shaped. The element 30' or the element 40' is fixed on the outer surface 21'. The cylindrical body 20' is fitted over the doorknob K corresponding in location to the magnetic seat M.

Figure 12:
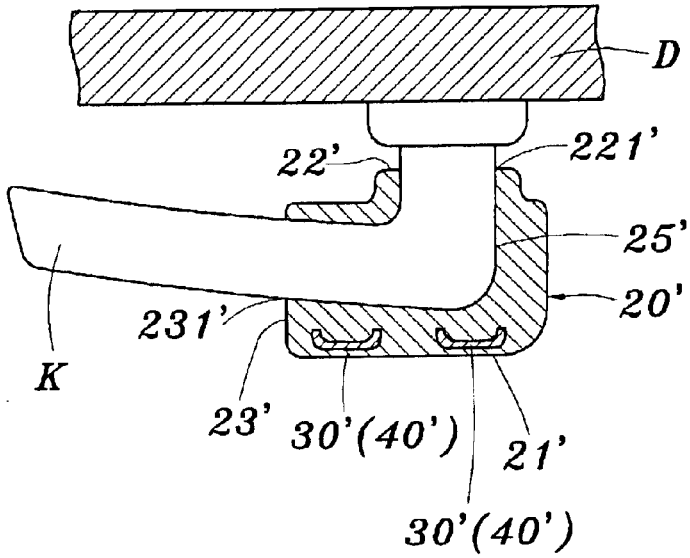
FIG. 12 shows another sectional view of the third preferred embodiment of the present invention comprising an embedded magnet or iron.

As shown in FIG. 12, the element 30' or 40' may be embedded in the outer surface 21' of the cylindrical body 20'.

Figure 13:
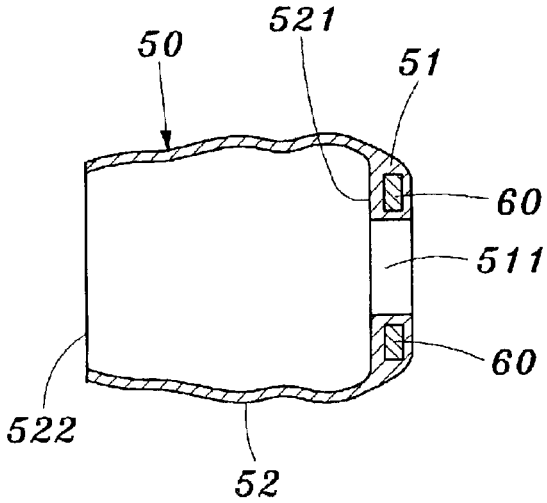
FIG. 13 shows a sectional schematic view of a fourth preferred embodiment of the present invention.

As shown in FIG. 13, the doorknob cover 50 of the fourth preferred embodiment of the present invention is formed of a base 51 and an expandable sleeve 52. The base 51 is provided in the center with a round hole 511 in which an element 60 is disposed. The element 60 is capable of being attracted magnetically. The expandable sleeve 52 is made of a silicone rubber material by blowing and is provided with a root portion 521 and a fitting mouth 522. The root portion 521 is connected with the outer surface of one of the sides of the base 51.

Figure 14:
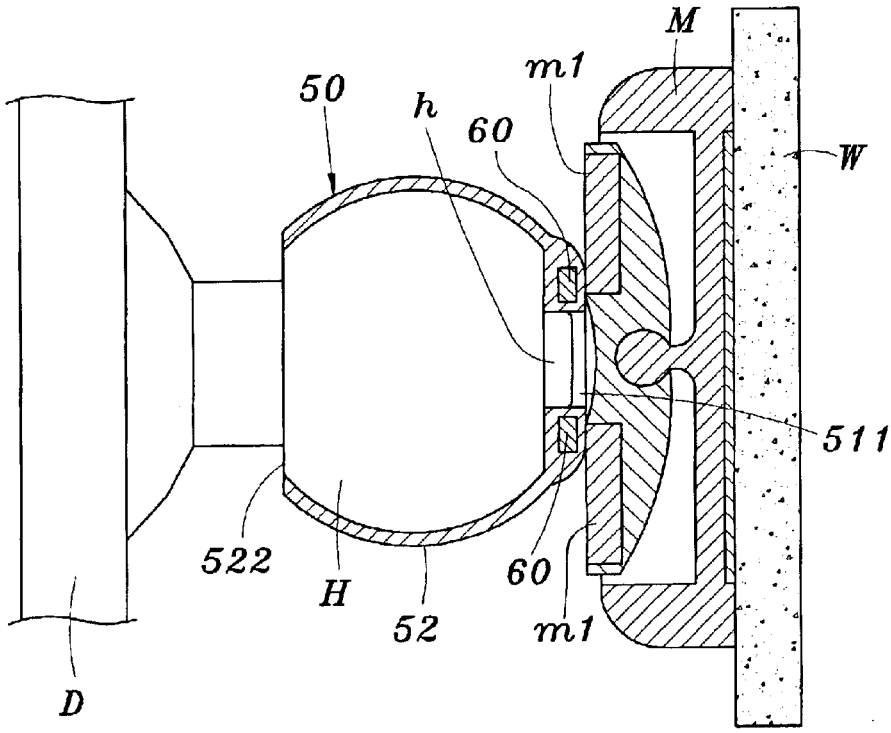
FIG. 14 shows a sectional schematic view of the fourth preferred embodiment of the present invention at work

As shown in FIG. 14, the fitting mouth 522 is stretched with fingers to fit the doorknob cover 50 over the doorknob H such that the expandable sleeve 52 embraces the doorknob H. When the door D is swiveled toward the magnetic seat M of the wall W, the doorknob H is arrested due to the fact that the magnet m1 of the magnetic seat M attracts the element 60.

What is claimed is:

1. A doorknob cover, comprising:

a hollow cylindrical body made of polyurethane or rubber by injection molding and provided with an outer surface, a first side surface, and a second side surface, said outer surface having a first side end and a second side end, said first side surface being connected with said first side end of said outer surface and provided in the center with a first hole edge, said first hole edge having a hole diameter smaller than an outer diameter of the doorknob, said second side surface being connected with said second side end and provided in the center with a second hole edge having a hole diameter smaller than the outer diameter of the doorknob, said second hole edge and said second side surface being provided therebetween with a protruded rib, said second hole edge and said first hole edge being provided therebetween with a continuous wall, said continuous wall, said first hole edge and said second hole edge forming together a hollow receiving cell; and an element capable of being magnetically attracted, said element being a metal and being fastened to an outermost side surface of said protruded rib of said cylindrical body in the course of injection molding by which said cylindrical body is made.

2. The doorknob cover, as recited in claim 1, wherein said cylindrical body is provided with an elastic portion which is located between said continuous wall, said first side surface, and the outer surface in proximity of said first side surface.

3. The doorknob cover, as recited in claim 1, wherein said element includes a magnet.

4. The doorknob cover, as recited in claim 1, wherein said element is positioned in said protruded rib of said cylindrical body in the course of the injection molding by which said cylindrical body is made.

5. The doorknob cover, as recited in claim 3, wherein said element is positioned in said protruded rib of said cylindrical body in the course of the injection molding by which said cylindrical body is made.

6. The doorknob cover, as recited in claim 1, wherein said protruded rib is configured to have a thickness greater than an extension length of a lock bolt of a doorknob.

7. The doorknob cover, as recited in claim 1, wherein said second hole edge of said cylindrical body is provided with an elastic film.

8. A doorknob cover, comprising:

a hollow body made of polyurethane or rubber by injection molding to cooperate with an L-shaped doorknob, said hollow body provided with an outer surface, a first side surface, and second side surface, with said outer surface being L-shaped, said first side surface and said second side surface being located at two ends of said L-shaped outer surface, said first side surface being provided with a first hole edge, said second side surface being provided with a second hole edge, said hollow body further provided with an L-shaped continuous wall located between said first hole edge of said first side surface and said second hole edge of said second side surface; and an element capable of being magnetically attracted, said element being a metal and being mounted on said outer surface in the course of the injection molding such that said element is configured to correspond to a location of a magnetic seat in a wall.

9. The doorknob cover, as recited in claim 8, wherein said element includes a magnet.

10. The doorknob cover, as recited in claim 8, wherein said element is embedded in said outer surface in the course of the injection molding by which said hollow body is made.

11. The doorknob cover, as recited in claim 9, wherein said element is embedded in said outer surface in the course of the injection molding by which said hollow body is made.

12. A doorknob cover comprising a base and an expandable sleeve, said base being provided in a center with a round hole and an element disposed in said round hole, said element is capable of being magnetically attracted, said expandable sleeve being made of a silicone rubber material by blowing and provided with a root portion and a fitting mouth whereby said root portion is connected with an outer surface of one of sides of said base.

13. The doorknob cover, as recited in claim 12, wherein said element includes a magnet.

* * * * *